US008640272B2

(12) United States Patent
Morita et al.

(10) Patent No.: US 8,640,272 B2
(45) Date of Patent: Feb. 4, 2014

(54) FLUSH TOILET BOWL

(75) Inventors: Tomoaki Morita, Fukuoka-ken (JP); Toshifumi Yoneda, Fukuoka-ken (JP); Tomohiro Hirakawa, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 947 days.

(21) Appl. No.: 12/593,320

(22) PCT Filed: Sep. 22, 2008

(86) PCT No.: PCT/JP2008/067123

§ 371 (c)(1),
(2), (4) Date: Nov. 24, 2009

(87) PCT Pub. No.: WO2009/050985

PCT Pub. Date: Apr. 23, 2009

(65) Prior Publication Data

US 2010/0186158 A1 Jul. 29, 2010

(30) Foreign Application Priority Data

Oct. 15, 2007 (JP) ..... 2007-267624

(51) Int. Cl.
*E03D 11/00* (2006.01)

(52) U.S. Cl.
USPC ..... 4/420; 4/425

(58) Field of Classification Search
USPC ..... 4/420, 421, 425, 428
See application file for complete search history.

(56) References Cited

U.S. PATENT DOCUMENTS

| | | | | |
|---|---|---|---|---|
| 6,145,138 | A * | 11/2000 | Nakamura et al. | 4/425 |
| 6,986,172 | B2 * | 1/2006 | Hidetaka et al. | 4/425 |
| 2004/0040080 | A1 * | 3/2004 | Prokopenko et al. | 4/420 |
| 2006/0005310 | A1 * | 1/2006 | Nakamura et al. | 4/420 |

FOREIGN PATENT DOCUMENTS

| | | | |
|---|---|---|---|
| JP | 08-120740 | A | 5/1996 |
| JP | 11-001954 | A | 1/1999 |
| JP | 2000-080711 | A | 3/2000 |
| JP | 2001-279788 | A | 10/2001 |
| JP | 3381261 | B2 | 2/2003 |
| JP | 2001-271407 | A | 10/2004 |
| JP | 2005-098003 | A | 4/2005 |
| JP | 2005-213881 | A | 8/2005 |
| JP | 2006-104936 | A | 4/2006 |

OTHER PUBLICATIONS

International Search Report for PCT/JP2008/067123, dated Oct. 21, 2008.

* cited by examiner

*Primary Examiner* — Tuan N Nguyen
(74) *Attorney, Agent, or Firm* — Pearne & Gordon LLP

(57) ABSTRACT

A flush toilet bowl includes: a bowl portion including a pooling portion in communication with a drain conduit; a rim surface provided above the bowl portion; and a first slit opening configured to spout flush water supplied through a first conduit toward the bowl portion and to spout the supplied flush water in a generally tangential direction of the rim surface, thereby generating a swirling flow flowing forward near a boundary between the rim surface and the bowl portion. A slit opening shape in a cross section generally perpendicular to a flow direction of water flow spouted from the first slit opening is horizontally flattened. There is provided a flush toilet bowl capable of minimizing the overhang of the rim portion.

6 Claims, 13 Drawing Sheets

FLUSH TOILET BOWL

TECHNICAL FIELD

This invention relates to a flush toilet bowl, and more particularly to a flush toilet bowl of the flush-down type, siphon type, siphon-jet type and the like.

BACKGROUND ART

A flush toilet bowl is disclosed in which flush water is spouted from a spout provided in the rim portion of the flush toilet bowl to generate a swirling flow for flushing the bowl (e.g., Patent Documents 1 and 2). In this type of flushing technique, adherence and persistence of soil and the like are less likely to occur on the inside of the rim of the toilet bowl, achieving good cleanability, and the entire surface of the bowl of the toilet bowl can be efficiently flushed with a small quantity of water.

Patent Document 1: JP-A-2001-271407 (Kokai)

Patent Document 2: Japanese Patent No. 3381261

DISCLOSURE OF INVENTION

Technical Problem

In this type of flush toilet bowl, the rim portion is provided with an overhang to prevent flush water generating the swirling flow from splashing out of the toilet bowl. Minimizing such overhang of the rim portion improves cleanability and serves to prevent adherence of soil and the like more reliably.

This invention is based on the recognition of these problems, and provides a flush toilet bowl capable of minimizing the overhang of the rim portion.

Technical Solution

According to an aspect of the invention, there is provided a flush toilet bowl including: a bowl portion including a pooling portion in communication with a drain conduit; a rim surface provided above the bowl portion; and a first slit opening configured to spout flush water supplied through a first conduit toward the bowl portion and to spout the supplied flush water in a generally tangential direction of the rim surface, thereby generating a swirling flow flowing forward near a boundary between the rim surface and the bowl portion, a slit opening shape in a cross section generally perpendicular to a flow direction of water flow spouted from the first slit opening being horizontally flattened.

EXPLANATION OF REFERENCE

Figure 1:
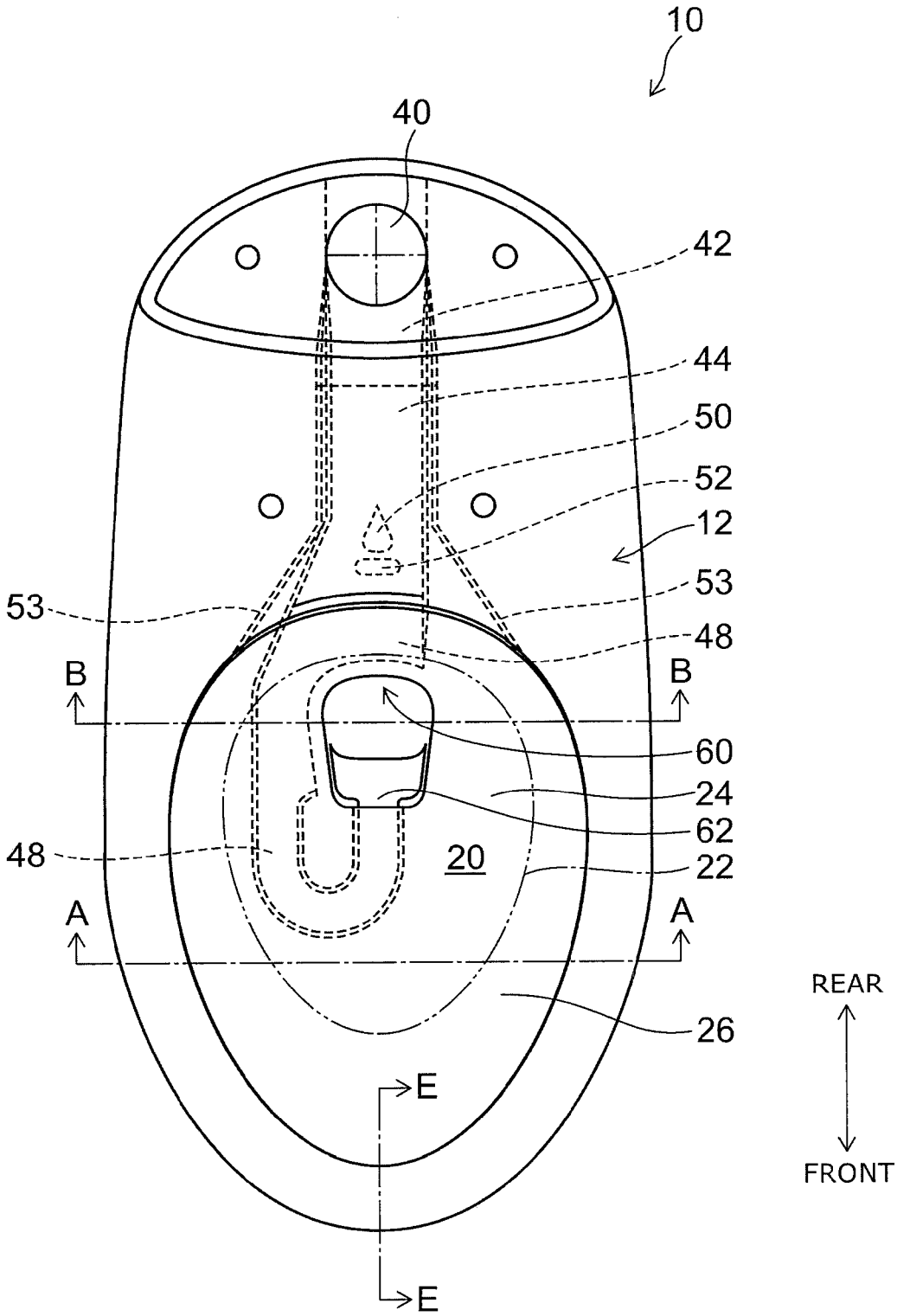
FIG. 1 is a plan view of a flush toilet bowl according to the embodiment of the invention.

10 flush toilet bowl
12 upper surface
20 bowl portion
22 pool water level
24 pooling surface
25, 125 shelf portion
26 exposed surface
28 boundary
30 rim portion
32 rim surface
32P overhang
40 water supply port
42 conduit
44 diaphragm
46 upper conduit
48 lower conduit
50 splitter
52 communication port
53 expanding portion
54 center slit opening
55 protrusion
56 slit opening
60 drain port
62 spout opening
64 ascending conduit
66 descending conduit
C, C1, C2 swirling flow
156 spout

BEST MODE FOR CARRYING OUT THE INVENTION

An embodiment of the invention will now be described with reference to the drawings. In the drawings, similar components are labeled with like reference numerals, and the detailed description thereof is omitted as appropriate.

FIG. 1 is a plan view of a flush toilet bowl according to the embodiment of the invention.

Figure 2:
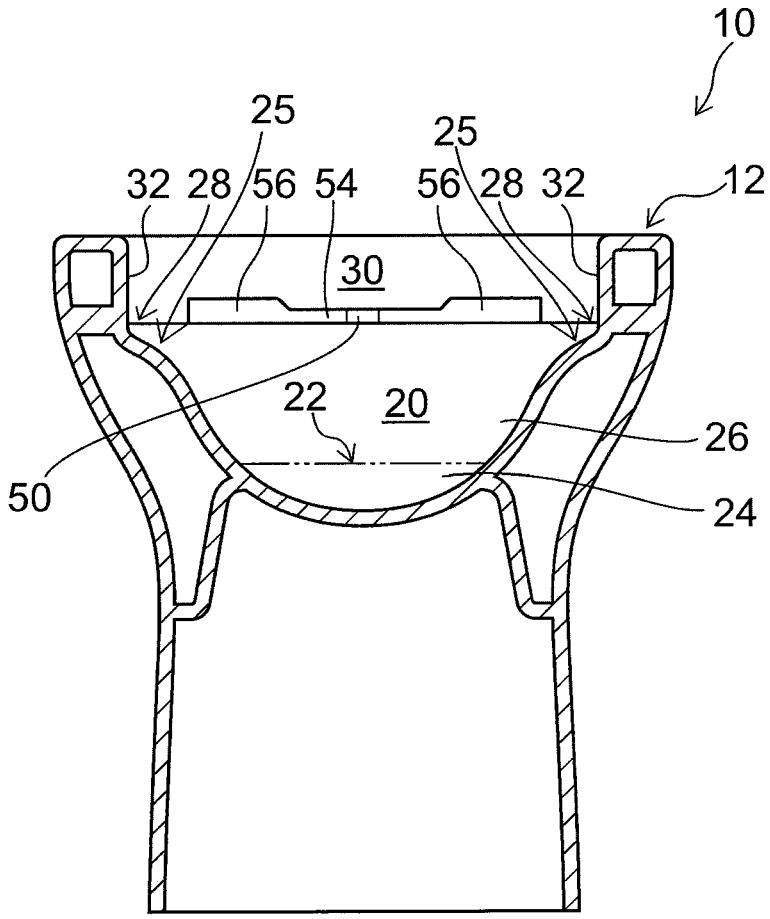
FIG. 2 is an A-A cross-sectional view of FIG. 1.

FIG. 2 is an A-A cross-sectional view of FIG. 1.

Figure 3:
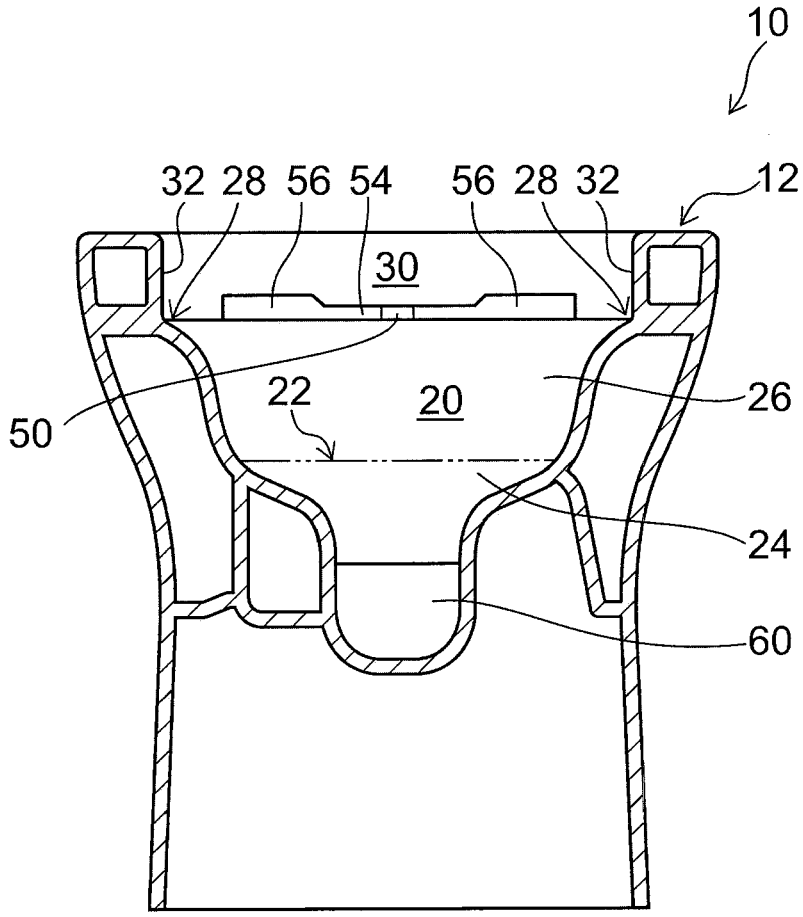
FIG. 3 is a B-B cross-sectional view of FIG. 1.

FIG. 3 is a B-B cross-sectional view of FIG. 1.

In front of the upper surface 12 of the flush toilet bowl 10 of this embodiment, a bowl portion 20 and a rim portion 30 provided thereabove are opened. In the rear of the upper surface 12, a water supply port 40 for introducing flush water is opened. Above the water supply port 40, for instance, a low tank, not shown, is attached so that flush water can be introduced from this low tank to the water supply port 40. Alternatively, flush water may be introduced from the waterworks through a flush valve, solenoid opening/closing valve or the like to the water supply port 40.

The bowl portion 20 has a pooling surface 24 located below the pool water level 22 and pooling flush water, and an exposed surface 26 exposed above the pool water level 22. As shown in FIG. 3, part of the pooling surface 24 extends downward deeply, and in the rear thereof is opened a drain port 60 communicating with a drain conduit. In normal condition, flush water is pooled up to the pool water level 22 to form a pool portion.

On the other hand, the rim portion 30 has a rim surface 32 surrounding the opening edge of the flush toilet bowl between the bowl portion 20 and the upper surface 12. A center slit opening 54 is provided near the center in the rear of the rim portion 30, and horizontally flattened slit openings 56, 56 are opened to the left and right thereof. A splitter 50 is provided in the rear of the center slit opening 54.

In this embodiment, flush water is spouted from each of the left and right flattened slit openings 56, 56. The flush water spouted forward from the slit openings 56, 56 flows forward down the exposed surface 26 of the bowl portion 20 while slightly spreading to the left and right, thereby flushing the bowl portion 20. Furthermore, the flush water spouted from the slit openings 56, 56 in a generally tangential direction of the rim surface 32 of the rim portion 30 generates a swirling flow swirling at the lower edge of the rim surface 32. This swirling flow flows forward along the boundary 28 between the rim surface 32 and the exposed surface 26.

Furthermore, in this embodiment, the slit opening shape in a cross section generally perpendicular to the flow direction of the water flow spouted from these slit openings 56, 56 is horizontally flattened. This restricts the vertical spread of the swirling flow so that flush water can be spouted in a horizontally wide range in front of the slit openings 56, 56. Furthermore, this can prevent the swirling flow swirling along the boundary 28 between the rim surface 32 and the exposed surface 26 from creeping up the rim surface 32 and splashing out of the toilet bowl, while distributing flush water over the exposed surface 26. Consequently, the overhang of the rim surface 32 for preventing the splash-out of the swirling flow can be reduced. In the specific example shown in FIGS. 2 and 3, the rim surface 32 is provided nearly vertically without substantial overhang. That is, the amount of overhang of the rim surface can be made smaller than the amount of protrusion of the shelf portion 25 (see FIG. 2) of the exposed surface 26 below the boundary 28. Thus, the flush water spouted from the slit openings to the left and right rim surface 32 generates a swirling flow directed forward along the lower edge of the rim surface 32, as opposed to a flow rising on the rim surface 32.

This reduction of the amount of overhang of the rim surface improves cleanability and serves to prevent adherence of soil and the like more reliably.

In the following, the structure of the conduit of flush water in the flush toilet bowl of this embodiment and the flow of flush water are described.

Figure 4:
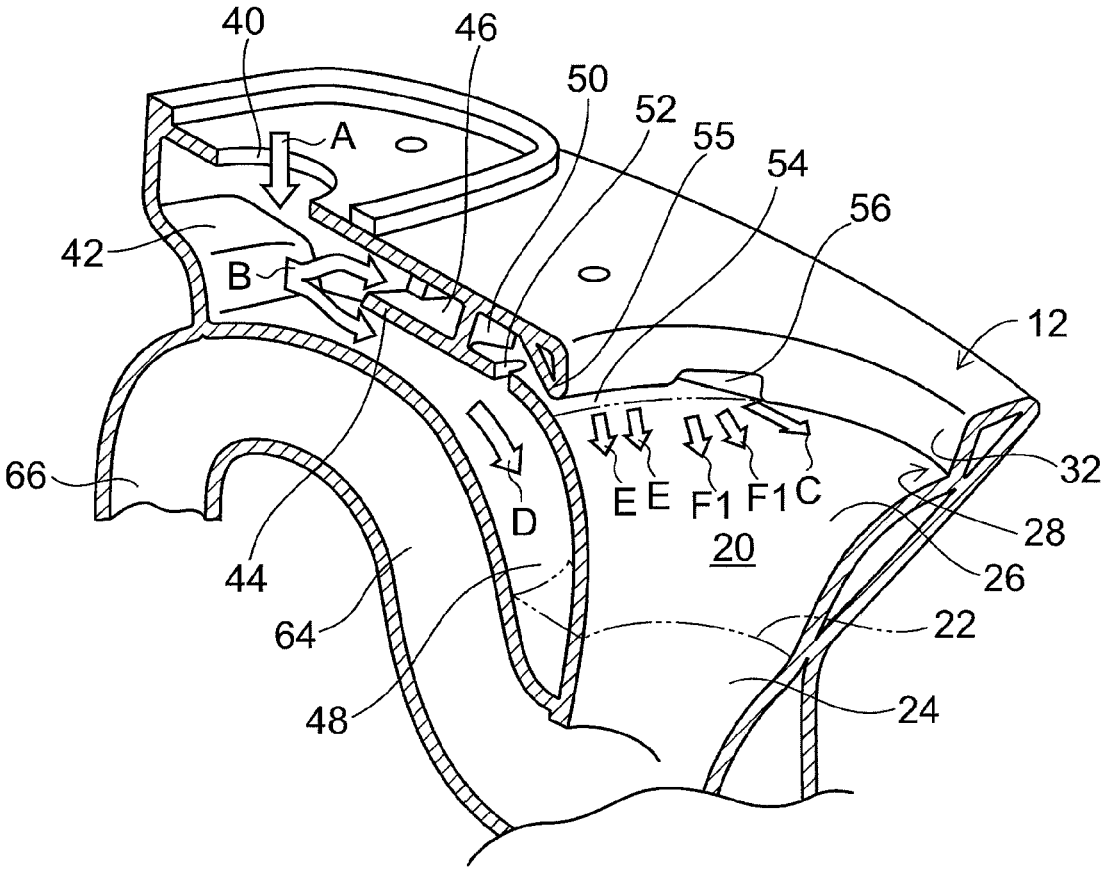
FIG. 4 is a partial cross-sectional schematic view illustrating the configuration of the conduit in the flush toilet bowl of this embodiment.

FIG. 4 is a partial cross-sectional schematic view illustrating the configuration of the conduit in the flush toilet bowl of this embodiment.

Figure 5:
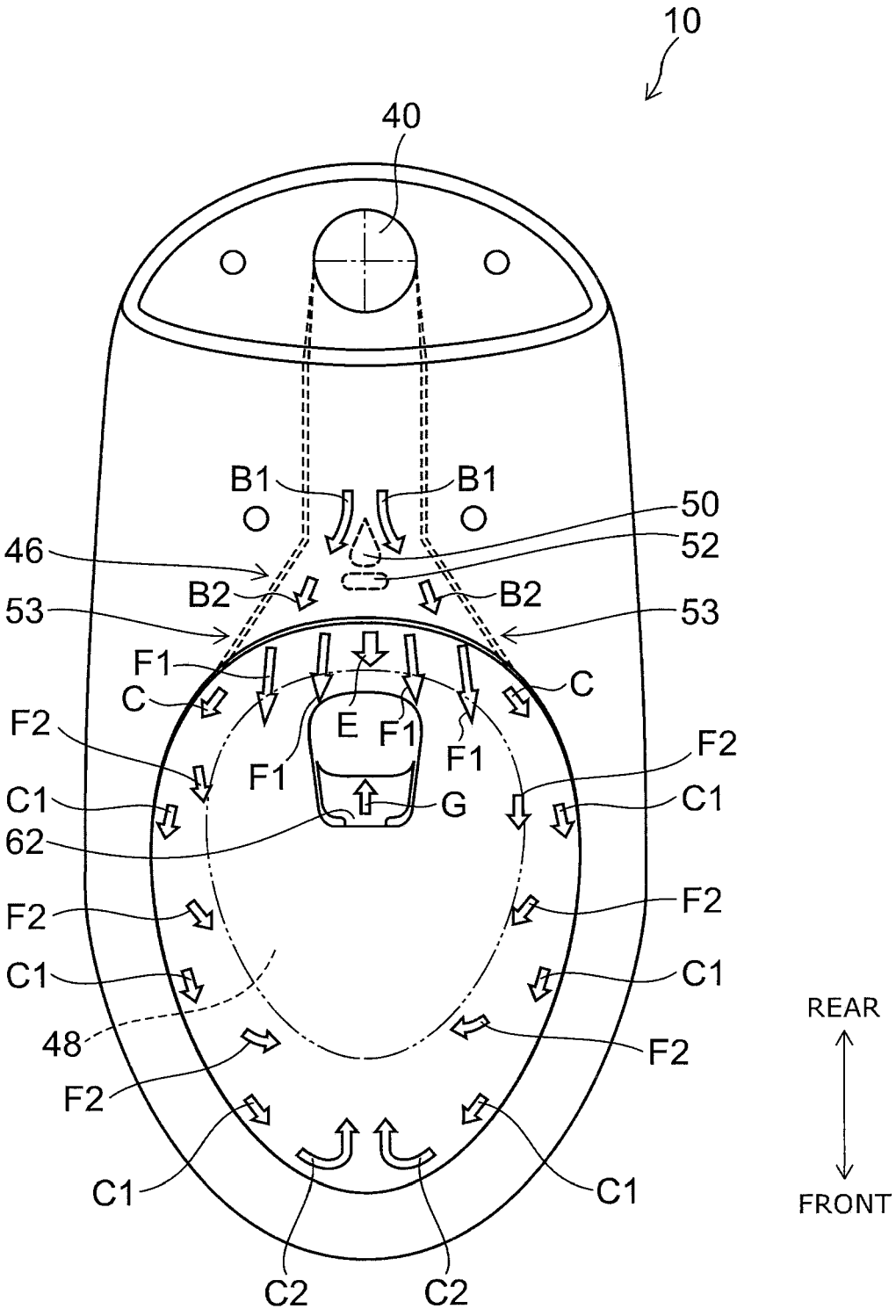
FIG. 5 is a schematic view for describing the flow of flush water in the flush toilet bowl of this embodiment.

FIG. 5 is a schematic view for describing the flow of flush water in the flush toilet bowl of this embodiment.

Figure 6:
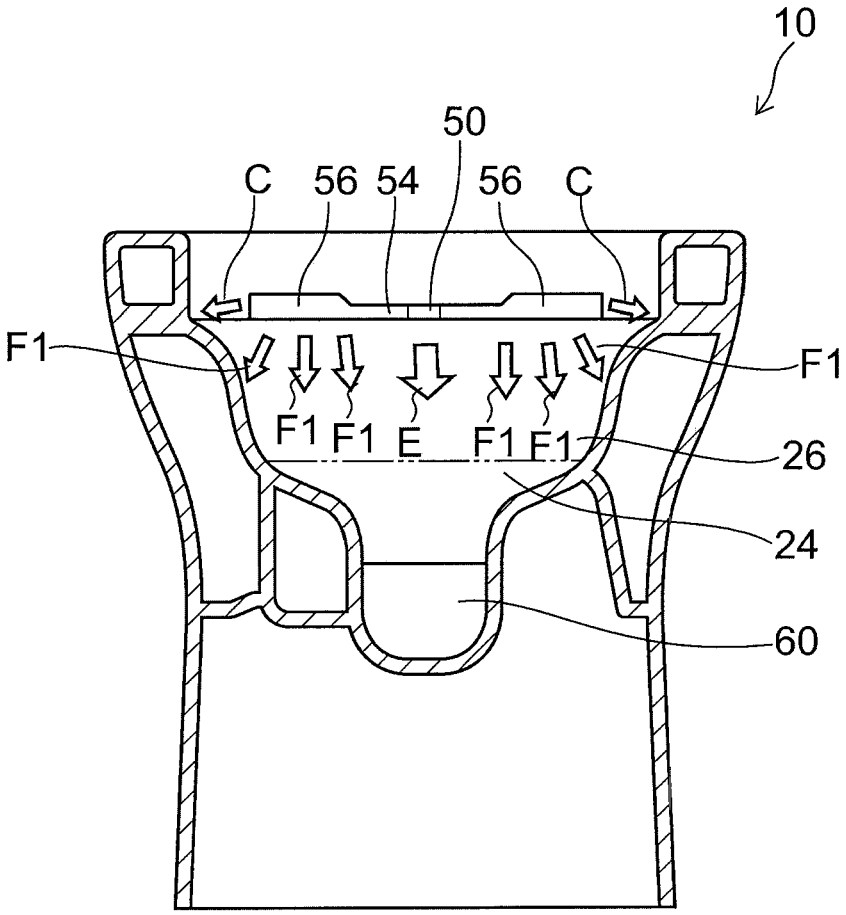
FIG. 6 is a schematic view of the slit openings as viewed from the front.

FIG. 6 is a schematic view of the slit openings as viewed from the front.

As shown in FIG. 4, the water supply port 40 provided in the rear of the upper surface 12 of the flush toilet bowl is in communication with the conduit 42 formed inside the flush toilet bowl. The conduit 42 extends toward the front of the flush toilet bowl 10 and is branched into an upper conduit 46 and a lower conduit 48 by a diaphragm 44. That is, flush water introduced from the water supply port 40 as shown by arrow A is vertically branched by the diaphragm 44 as shown by arrow B and supplied to the upper conduit 46 and the lower conduit 48.

The upper conduit 46 extends above the diaphragm 44 toward the front of the flush toilet bowl, and as shown in FIG. 5, includes an expanding portion 53 with its channel width (horizontal width in FIG. 5) expanding forward. Furthermore, a splitter 50 is provided near the upstream end portion of the expanding portion 53 and near the center of the upper conduit 46. The splitter 50 splits flush water flowing through the upper conduit 46 into the left and right, each guided to the expanding portion 53. The flush water split by the splitter 50 as shown by arrow B1 in FIG. 5 changes its flow direction to the left and right as shown by arrow B2 along the left and right expanding channel of the expanding portion 53, and is spouted forward as shown by arrows F1, C. The flush water spouted forward from the slit opening 56 as shown by arrow F1 flushes the bowl portion 20 below and before the slit opening 56 while slightly expanding to the left and right. On the other hand, the flush water spouted from the left and right slit openings 56, 56 along a generally tangential direction of the rim surface 32 as shown by arrow C generates, respectively, a swirling flow traveling forward along the boundary 28 between the rim surface 32 and the bowl portion 20 as shown by arrow C1 in FIG. 5 so that the vicinity of the lower edge of the rim surface 32 can be flushed. These swirling flows swirl along the boundary 28 between the rim surface 32 and the bowl portion 20, meet each other near the front end portion of the rim surface 32, and flow down to the bowl portion 20 as shown by arrow C2, thereby serving to flush the surface of the exposed surface 26 in the front of the bowl portion 20, generate a main flow toward the drain port 60, and push wastes thereto with pool water. Furthermore, part of the swirling flow shown by arrow C1 successively flows down to the bowl portion 20 as shown by arrow F2 (see FIG. 5) and successively flushes the surface of the exposed surface 26 of the bowl portion 20.

On the other hand, the lower conduit 48 formed below the diaphragm 44 extends on the backside of the pooling surface 24 as shown in FIGS. 1 and 5, and is in communication with the spout opening 62 opposed to the drain port 60 of the drain conduit. Thus, the flush water passed through the lower conduit 48 is spouted from the spout opening 62 toward the drain port 60 of the drain conduit as shown by arrow G in FIG. 5. This spouted flow acts as a so-called "jet", serving to push the flush water containing bodily wastes from the opposed drain port 60 toward the drain conduit.

On the other hand, a communication port 52 is provided downstream of the splitter 50 provided in the upper conduit 46. As shown in FIG. 4, the communication port 52 allows the upper conduit 46 and the lower conduit 48 to communicate with each other. This communication port 52 serves as an opening for so-called "air vent" when flush water flows into the lower conduit 48. More specifically, the downstream side of the lower conduit 48 communicates with the spout opening 62 and opens into the pool water. Hence, to smoothly introduce flush water into the lower conduit 48, air remaining in the conduit needs to be rapidly exhausted. In this regard, this embodiment provides a communication port 52, so that air remaining in the lower conduit 48 can be rapidly exhausted, and as shown by arrow D in FIG. 4, flush water can be smoothly introduced into the lower conduit 48. Here, the air exhausted from the communication port 52 passes through the expanding portion 53 constituting a relatively wide channel and is exhausted to the slit openings. Thus, the compressed air exhausted from the communication port 52 reduces its force when it hits against the backside of the upper surface 12 and passes through the expanding portion 53, and then is released from the slit openings. Hence, the splash-out of water from the slit openings can be prevented.

Furthermore, when flush water is thus smoothly introduced and fills the lower conduit 48, part of the water overflows from the lower conduit 48 through the communication port 52 into the upper conduit 46. The flush water thus overflowed flows downward from the center slit opening 54 and flushes the surface of the exposed surface 26 in the rear of the bowl portion 20. At this time, flush water is spouted from the center slit opening 54 toward the bowl portion 20 therebelow as shown by arrow E in FIGS. 4 to 6. The spouted flush water slightly spreads to the left and right and flows down the surface of the exposed surface 26 extending therebelow, thereby serving to flush the bowl portion 20, push wastes and the like floating on the pool water surface into the pool water, and guide them to the drain port 60.

On the other hand, flush water spouted from the portion of the left and right slit openings 56, 56 near the center slit opening 54 flows slightly obliquely downward as shown by arrow F1 and flushes the rear of the bowl portion 20. At this time, the flow of flush water spouted from the center slit opening 54 as shown by arrow E and the flow of flush water spouted from the left and right slit openings 56, 56 as shown by arrow F1 can entirely cover and evenly flush the rear of the bowl portion 20.

Thus, flush water spouted from the left and right slit openings 56, 56 and the center slit opening 54 evenly flushes the rim surface 32 and the exposed surface 26 of the bowl portion 20, and the water flows down the bowl portion 20 to raise the water level of the bowl portion 20. Simultaneously, water containing bodily wastes is pushed into the drain port 60 of the drain conduit by the flush water spouted from the spout opening 62. By these flows, flush water containing bodily wastes fills the ascending conduit 64 (see FIG. 4) of the drain conduit. Furthermore, it rapidly flows out to the descending conduit 66, thereby causing siphonage, and is drained at a burst.

After the flush water is drained by siphonage, flush water spouted from the left and right slit openings 56, 56 and the spout opening 62 again raises the water level of the bowl portion 20 up to the pool water level 22.

As described above, according to this embodiment, the flow F1 spouted forward from the left and right slit openings 56, 56 and the flow E flowing down from the center slit opening 54 flush the rear and part of the front of the bowl portion 20. Furthermore, the swirling flows C, C1, C2 spouted from the slit openings 56, 56 flush the lower edge of the rim surface 32, and the flow F2 generated by the downflow of part of these swirling flows evenly flushes the front side of the bowl portion 20. That is, the flows F1, C spouted from the left and right slit openings 56, 56 and the flow E flowing down from the center slit opening 54 can evenly flush the entire surface of the bowl portion 20.

According to experiments by the inventors, even if the total quantity of water supplied to the upper conduit 46 and the lower conduit 48 is reduced to approximately 4.3 liters, the flush toilet bowl can be reliably flushed by evenly distributing flush water over the substantially entire surface of the bowl portion 20 and the rim portion 30. Furthermore, the ratio between the quantity V1 of flush water supplied to the upper conduit 46 and the quantity V2 of flush water supplied to the lower conduit 48 can be in the range of, for instance, V1:V2=3:7 to 1:4.

Furthermore, in this embodiment, the cross-sectional shape of the spouted flow of flush water spouted from the left and right slit openings 56, 56 is horizontally flattened. This serves to effectively prevent the swirling flow C1 from splashing out of the flush toilet bowl.

Figure 7:
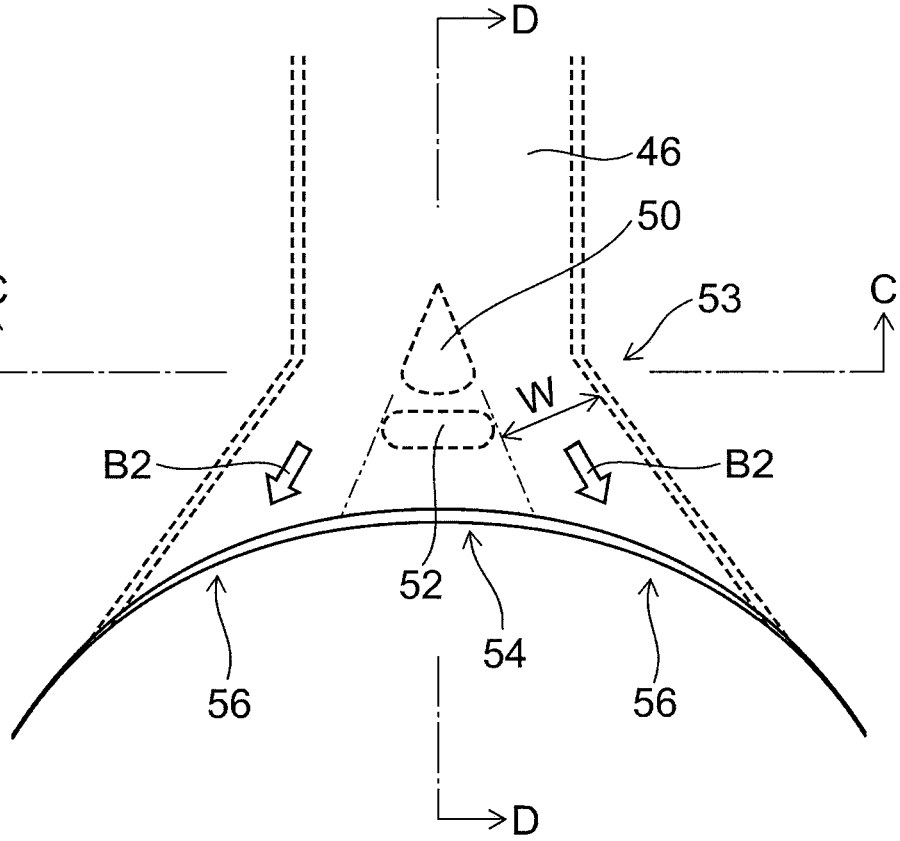
FIG. 7 is a partial enlarged plan view of the upper conduit.

FIG. 7 is a partial enlarged plan view of the upper conduit.

Figure 8:
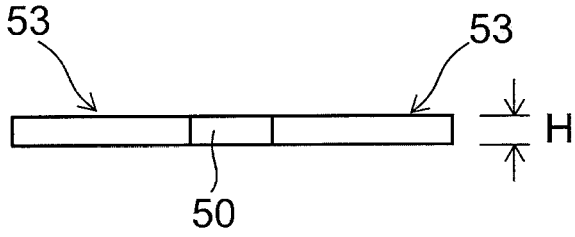
FIG. 8 is a C-C cross-sectional view of FIG. 7.

FIG. 8 is a C-C cross-sectional view of FIG. 7.

The expanding portion 53 of the upper conduit 46 forms a channel in which the flow direction is branched into the left and right as shown by arrows B2, each flow spouted from the slit openings 56, 56. The slit opening shape in a cross section generally perpendicular to the flow direction of this channel is horizontally flattened. For instance, supposing that each water flow formed is generally parallel to the sidewall of the splitter 50, the ratio of the width W (see FIG. 7) and the height H (see FIG. 8) of the water flow shown by arrow B2 is W:H=2:1 or more. Such a flattened water flow spouted from each of the slit openings 56, 56 serves to effectively prevent the swirling flow C1 from rising up the rim surface 32 and splashing out over the upper surface 12 of the toilet bowl. That is, the flattened water flow thus spouted serves to generate a swirling flow with a prescribed flow rate while restricting its vertical spread. The overhang of the rim surface 32 can be reduced by restricting the vertical, particularly upward spread of the swirling flow C1.

Furthermore, as the upper and lower edge of the cross section of the channel of the water flow shown by arrow B2 and the slit openings 56, 56 are close to a straight line, a tendency to restrict the vertical spread of the spouted swirling flow is observed.

Furthermore, the vertical spread of flush water on the rim surface side can be further restricted by gradually decreasing the opening width of the slit opening on the rim surface side relative to the opening width at the center to reduce the spouted amount on the rim surface side.

Figure 9:
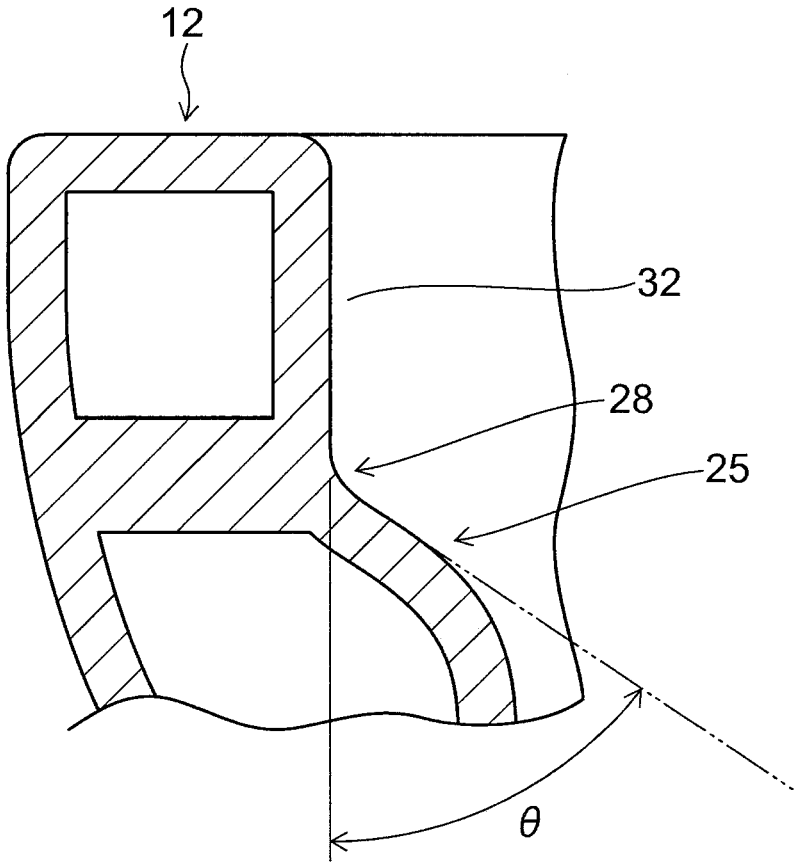
FIG. 9 is a partial enlarged view of FIG. 3, showing a cross section near the rim surface 32.

FIG. 9 is a partial enlarged view of FIG. 3, showing a cross section near the rim surface 32.

As shown in FIG. 9, in this embodiment, the overhang of the rim surface 32 is very small, and the rim surface 32 is formed into a nearly vertical surface. This is achieved by the fact that the cross section of the spouted flow spouted from the slit openings 56, 56 as viewed in a direction generally perpendicular to its flow direction is formed into a flattened shape to effectively restrict the upward spread of the swirling flow C1. In other words, if the upward spread of the swirling flow C1 is large, the overhang of the rim surface 32 needs to be enlarged to avoid splashing out of the toilet bowl. That is, the upper portion of the rim surface 32 needs to be beveled toward the bowl.

Figure 10:
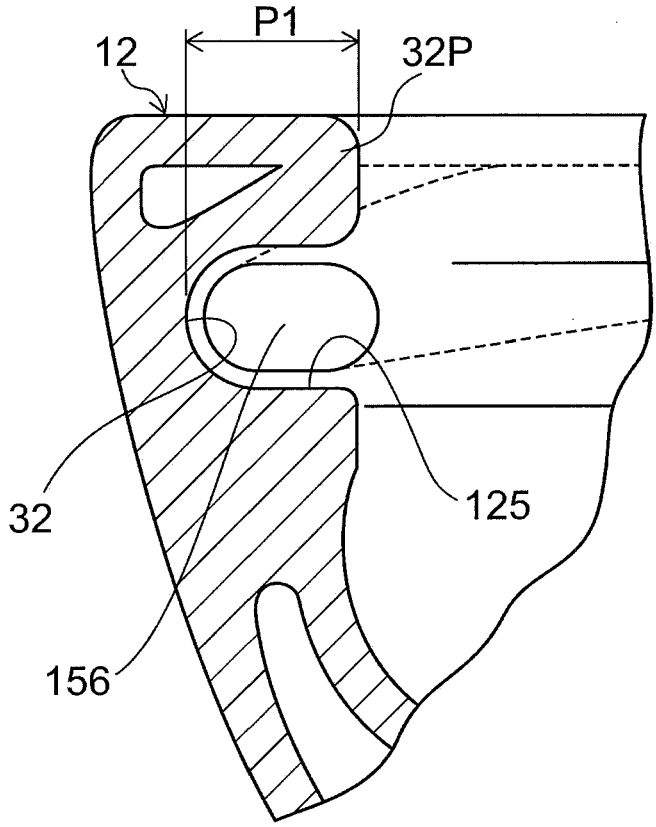
FIG. 10 is a schematic cross-sectional view showing part of a flush toilet bowl according to a comparative example.

FIG. 10 is a schematic cross-sectional view showing part of a flush toilet bowl according to a comparative example.

More specifically, FIG. 10 shows a cross-sectional structure near the opening of a spout 156 for generating a swirling flow. In this comparative example, the spout 156 is not substantially flattened. Hence, flush water spouted from the spout 156 is likely to spread vertically. Thus, in this comparative example, to restrict the vertical spread of the swirling flow, a shelf portion 125 is provided below the rim surface 32 serving as a channel of the swirling flow, and an overhang 32P protruding significantly is further provided above the rim surface 32. That is, an overhang 32P is formed above the channel of the swirling flow, and a shelf portion 125 is formed below the channel of the swirling flow. With respect to the bottom surface of the rim surface 32, the amount of protrusion P1 of the shelf portion 125 is comparable to that of the overhang 32P.

In contrast, according to this embodiment, the overhang of the rim surface 32 can be minimized by restricting the upward spread of the swirling flow C1. That is, as described above with reference to FIGS. 1 to 6 and the like, the overhang of the rim surface 32 can be reduced, and the amount of its protrusion can be made significantly smaller than the amount of protrusion of the shelf portion 25. This further improves cleanability and serves to further prevent adherence of soil and the like.

In this embodiment, as shown in FIG. 9, the rim surface 32 is formed into a generally vertical surface. The upper end of the exposed surface 26 of the bowl portion 20 continuing therebelow is beveled to serve as a shelf portion 25 for supporting the swirling flow C1 from below and directing it forward. According to this embodiment, the swirling flow spouted from the slit openings 56, 56 only needs to reach the front end of the toilet bowl, and does not need to go around any longer. Hence, the protrusion of the shelf portion 25 can be reduced. For instance, the bevel angle θ at the upper end of the shelf portion 25 can be reduced to approximately 45 degrees. That is, unevenness and step difference on the shelf portion 25 can be reduced, and the bowl surface can be formed from a smoother and more continuous surface. Reduction of unevenness and step difference on the bowl surface serves to more effectively prevent adherence and persistence of soil, and facilitates wiping it out quickly and evenly with a rag, for instance. Thus, cleanability can be further improved.

Figure 11:
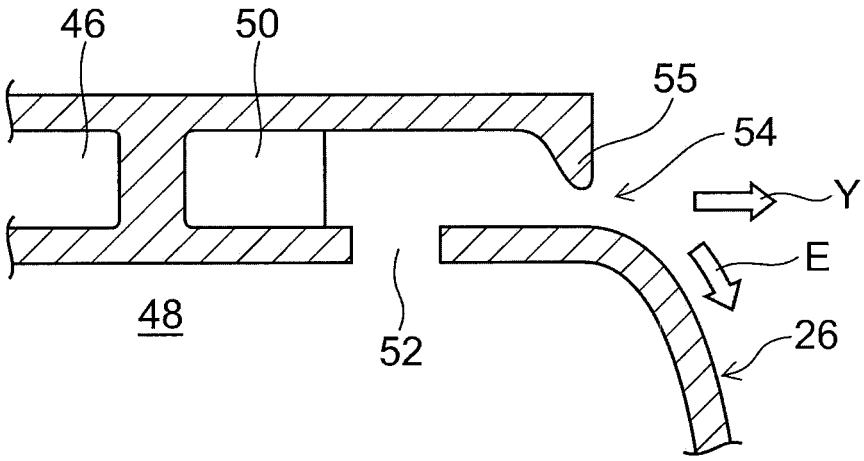
FIG. 11 is a D-D cross-sectional view of FIG. 7.

FIG. 11 is a D-D cross-sectional view of FIG. 7.

A communication port 52 is provided behind the center slit opening 54. Flush water overflowed from the lower conduit 48 through the communication port 52 into the upper conduit 46 and part of the flush water split to the left and right by the splitter 50 are spouted from the center slit opening 54.

A protrusion 55 (see also FIG. 4) protruding downward is provided at the opening portion of the center slit opening 54 above the upper conduit 46. That is, the direction of the flush water spouted from the center slit opening 54 is modified downward by the protrusion 55. Here, if flush water spouted from the center slit opening 54 is forcefully spouted forward as shown by arrow Y, the exposed surface 26 of the bowl portion 20 immediately below the center slit opening 54 may fail to be flushed. In contrast, according to this embodiment, flush water spouted from the center slit opening 54 is directed downward by the protrusion 55, and thus caused to flow down the exposed surface 26 of the bowl portion 20 immediately therebelow as shown by arrow E, so that its surface can be evenly flushed. This serves to push wastes and the like floating on the pool water surface into the pool water, and guide them to the drain port 60, thereby achieving effective flushing.

In the following, the result of experiments performed by the inventors is described.

Figure 12:
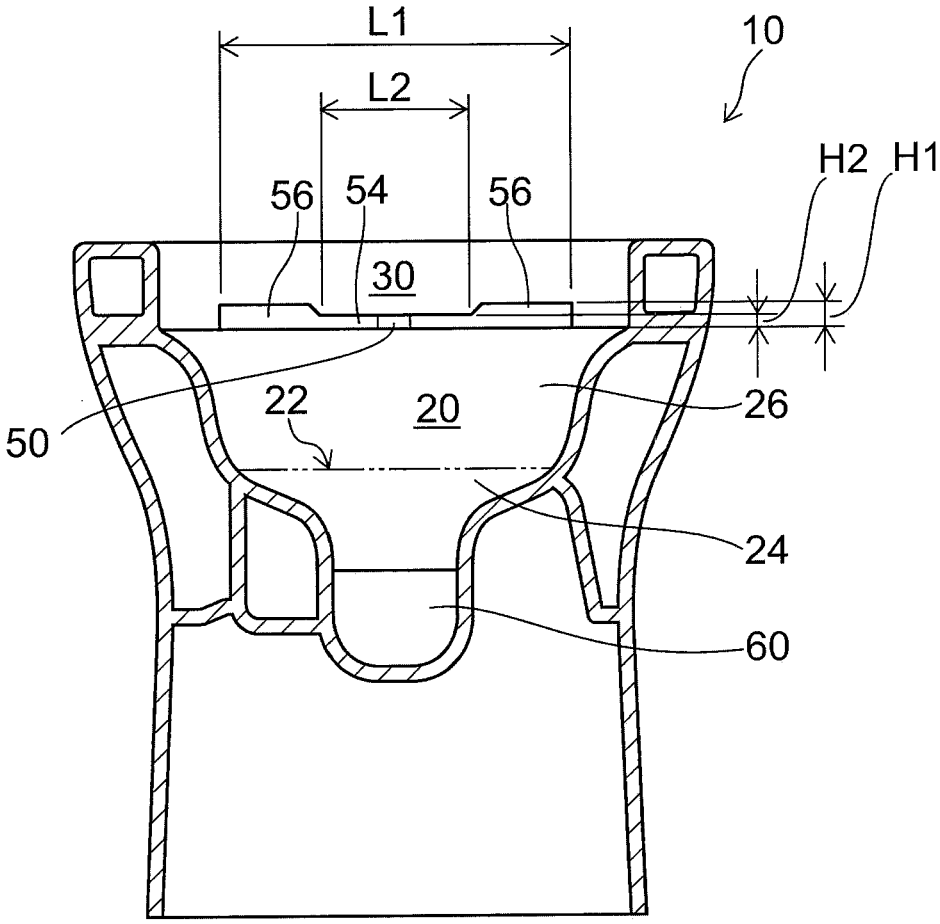
FIG. 12 is a schematic view illustrating the dimensions of the slit openings in a flush toilet bowl prototyped by the inventors.

FIG. 12 is a schematic view illustrating the dimensions of the slit openings in a flush toilet bowl prototyped by the inventors. Here, the end-to-end width L1 of the left and right slit openings 56, 56 was 185 millimeters, and the width L2 of the center slit opening 54 was 90 millimeters. The height H1 of the left and right slit opening 56, 56 was 7 millimeters or 6 millimeters, and the height H2 of the center slit opening 54 was 6 millimeters or 5 millimeters.

Flush water was supplied from a low tank to the water supply port 40, its total quantity of water was 4.3 liters, and the maximum instantaneous flow rate was 210 liters per minute. The quantity of water supplied to the upper conduit 46 was 1.2 liters, and the quantity of water supplied to the lower conduit 48 was 3.1 liters.

Figure 13A:
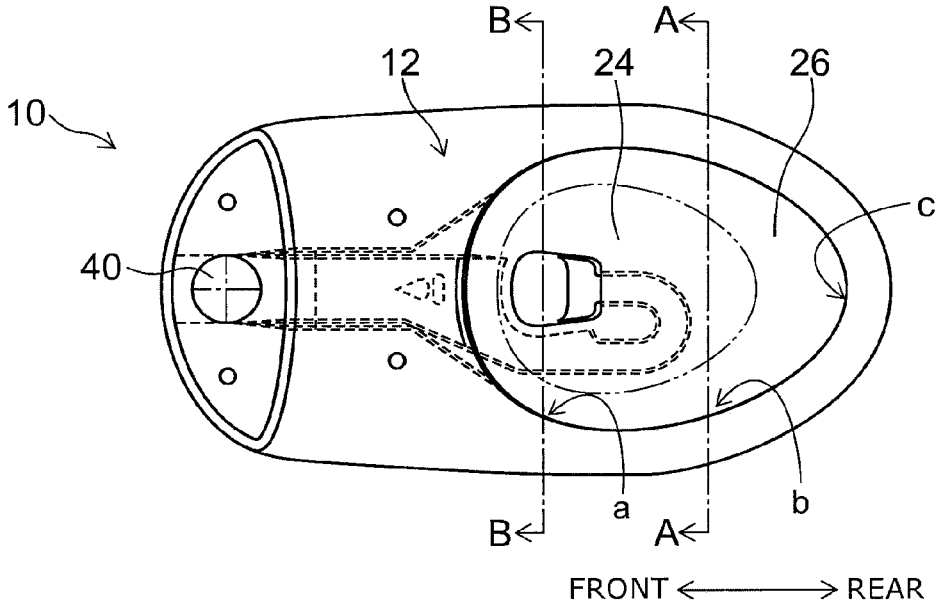
FIGS. 13A to 13C are schematic views for describing the contents of evaluation. Here, FIGS. 13A to 13C correspond to FIGS. 1, 3, and 2, respectively.
Figure 13B:
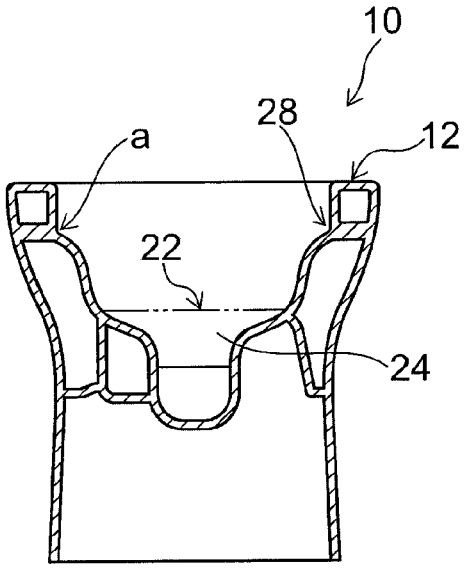
Figure 13C:
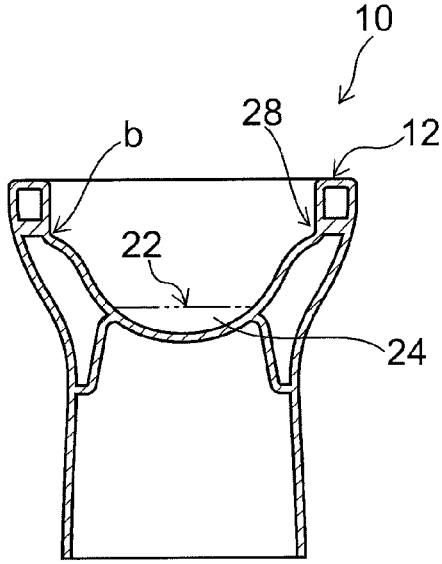

FIG. 13 is a schematic view for describing the contents of evaluation. Here, FIGS. 13A to 13C correspond to FIGS. 1, 3, and 2, respectively.

At point a and point b shown in FIGS. 13A to 13C, the upward spread of the swirling flow swirling on the rim surface 32 was measured. That is, the distance from the boundary 28 between the rim surface 32 and the shelf portion 25 to the upper end of the swirling flow C1 was measured. In the prototyped flush toilet bowl, the distance from the boundary 28 to the upper surface 12 was 45 millimeters at point a, and 55 millimeters at point b. The rim surface 32 was formed into a nearly vertical surface, that is, a surface generally parallel to the vertical direction. The bevel angle of the shelf portion 25 immediately below the boundary 28 was approximately 45 degrees as described above with reference to FIG. 9.

On the other hand, it was evaluated whether the swirling flow reaches point c shown in FIG. 13A and is distributed over the exposed surface 26 of the bowl portion 20 immediately therebelow.

TABLE 1 shows the result of experiments with the instantaneous flow rate of the swirling flow flowing on the rim surface 32 being varied. Here, the distance (millimeter) from the boundary 28 to the upper end of the swirling flow C1 at points a and b is shown. For point c, "o" indicates that flush water was distributed over the exposed surface 26 of the bowl portion 20 immediately therebelow.

TABLE 1

| Instantaneous flow rate on the rim (L/min) | Point a (mm) | Point b (mm) | Point c (mm) |
|---|---|---|---|
| 75 | 4.5 | 2.5 | ○ |
| 100 | 5.0 | 5.0 | ○ |
| over 100 | 6.0 | 5.0 | ○ |

Here, the height H1 of the slit openings 56, 56 was 7 millimeters, and the height H2 of the center slit opening 54 was 6 millimeters.

As seen from the result of TABLE 1, for instance, even if the instantaneous flow rate of the swirling flow flowing on the rim surface 32 exceeds 100 liters per minute, the distance from the boundary 28 to the upper end of the swirling flow is 6.0 millimeters at point a, and 5.0 millimeters at point b, indicating that the upward spread of the swirling flow is sufficiently restricted. Furthermore, the swirling flow reaches point c so that the exposed surface 26 of the bowl portion 20 immediately therebelow can be evenly flushed.

Hence, it can be seen that while the distance from the boundary 28 to the upper surface 12 was 45 millimeters at point a and 55 millimeters at point b in the prototyped flush toilet bowl, these distances can be significantly reduced. For instance, if the distance from the boundary 28 to the upper surface 12 is set to e.g. approximately 10 millimeters at points a and b, the substantially entire surface of the rim surface 32 can be flushed while preventing the splash-out of the swirling flow.

Next, TABLE 2 shows the result in the case where the heights H1, H2 of the slit openings were 6 millimeters and 5 millimeters, respectively. Here, the distance (millimeter) from the boundary 28 to the upper end of the swirling flow C1 at points a and b is shown. For point c, "o" indicates that flush water was distributed over the exposed surface 26 of the bowl portion 20 immediately therebelow.

TABLE 2

| Slit width (mm) | Point a (mm) | Point b (mm) | Point c (mm) |
|---|---|---|---|
| 6 | 6.0 | 5.0 | ○ |
| 5 | 3.0 | 2.5 | ○ |

As seen from TABLE 2, by lowering the heights H1, H2 of the slit openings, the upward spread of the swirling flow flowing on the rim surface 32 can be restricted more effectively. Simultaneously, the flushing effect at point c can be maintained at a high level.

As seen from the result of TABLE 2, in the case where the heights H1, H2 of the openings are lowered, even if the distance from the boundary 28 to the upper surface 12 is set to e.g. approximately 5 millimeters at points a and b, the substantially entire surface of the rim surface 32 can be flushed while preventing the splash-out of the swirling flow.

Figure 14:
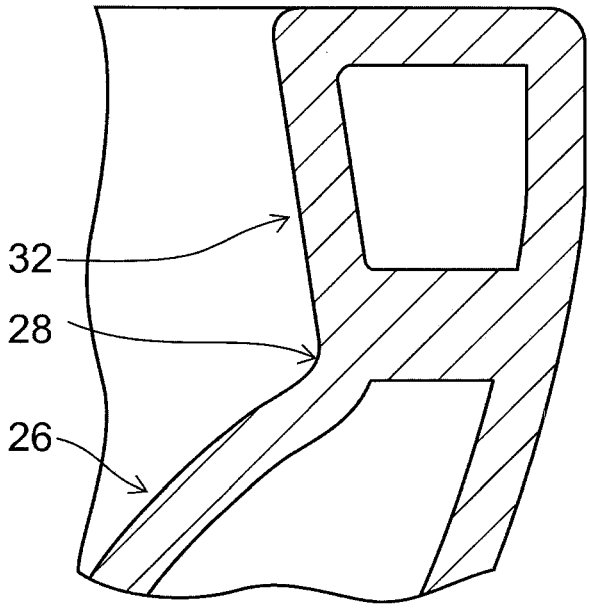
FIG. 14 is a partial cross-sectional view showing variations of the flush toilet bowl of this embodiment. More specifically, these figures correspond to a E-E cross-sectional view of FIG. 1.
Figure 15:
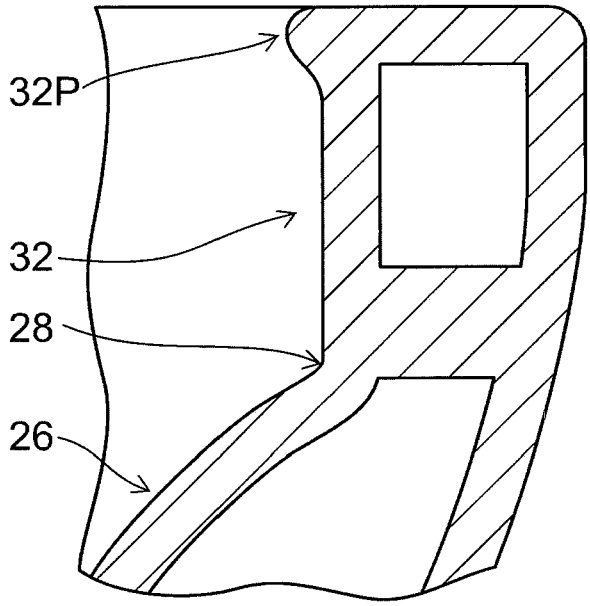
FIG. 15 is a partial cross-sectional view showing variations of the flush toilet bowl of this embodiment. More specifically, these figures correspond to a E-E cross-sectional view of FIG. 1.
Figure 16:
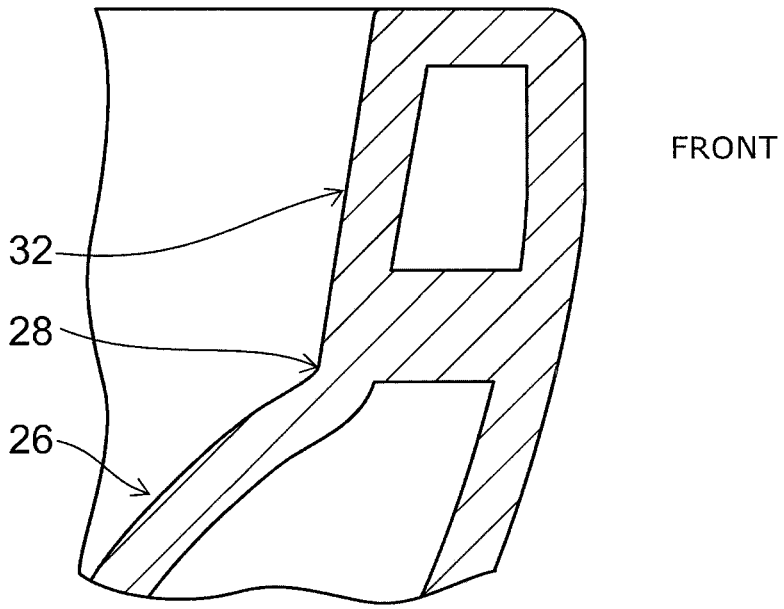
FIG. 16 is a partial cross-sectional view showing variations of the flush toilet bowl of this embodiment. More specifically, these figures correspond to a E-E cross-sectional view of FIG. 1.

FIGS. 14 to 16 are partial cross-sectional views showing variations of the flush toilet bowl of this embodiment. More specifically, these figures correspond to a E-E cross-sectional view of FIG. 1.

In this embodiment, the cross-sectional shape of the water flow of flush water spouted from the left and right slit opening 56 is flattened, and thereby the upward spread of the swirling flow flowing along the boundary 28 can be restricted. However, when the swirling flows with the upward spread thus restricted come from left and right and meet on the rim surface 32 at the front end portion of the flush toilet bowl 10, part of the water may splash out of the toilet bowl because the forces of water are combined. Thus, in such cases, the rim surface 32 may be provided with an overhang in front of the flush toilet bowl.

In this case, as shown in FIG. 14, an overhang beveled downward can be provided throughout the vertical length of the rim surface 32. Alternatively, as shown in FIG. 15, an overhang 32P can be provided so as to protrude only at the top of the rim surface 32. Then, while the rim surface 32 to the left and right of the flush toilet bowl is formed into a nearly vertical surface, an overhang can be provided as needed only in front. This serves to maximize cleanability and maximally prevent soil and the like while reliably preventing the splash-out of the swirling flow.

It is needless to say that the overhang as illustrated in FIG. 14 or 15 can be provided as needed also on the rim surface 32 to the left and right of the flush toilet bowl. Also in such cases, according to this embodiment, the cross-sectional shape of the water flow of flush water spouted from the left and right slit opening 56 is flattened, and thereby the upward spread of the swirling flow flowing on the rim surface 32 can be restricted. Hence, the amount of overhang can be minimized.

Furthermore, as shown in FIG. 16, the rim surface 32 can be beveled outward throughout its vertical length. This allows a user to view the entire surface of the rim surface 32 and the bowl portion 20 from above, further improving cleanability.

The embodiment of the invention has been described with reference to specific examples. However, the invention is not limited to these specific examples. The above embodiment can be suitably modified in design by those skilled in the art, and such modifications are also encompassed within the scope of the invention as long as they fall within the spirit of the invention. For instance, the shape, size, and structure of the flush toilet bowl are not limited to those illustrated, but can be suitably modified. With regard to the material of the flush toilet bowl, it can be formed not only from ceramics, but also from, for instance, acrylic and other resins, or other various organic materials, or those with various coatings on the surface thereof.

Furthermore, the components of the above specific examples can be combined with each other as long as technically feasible, and such combinations are also encompassed within the scope of the invention as long as they fall within the spirit of the invention.

INDUSTRIAL APPLICABILITY

Effect of the Invention

This invention can provide a flush toilet bowl capable of minimizing the overhang of the rim portion.

What is claimed is:

1. A flush toilet bowl comprising:

a bowl portion including a pooling portion in communication with a drain conduit;

a rim surface provided above the bowl portion;

a first slit opening configured to spout flush water supplied through a first conduit toward the bowl portion and to spout the supplied flush water in a generally tangential direction of the rim surface, thereby generating a swirling flow swirling at the lower edge of the rim surface;

a second slit opening configured to spout flush water supplied through the first conduit toward the bowl portion and to spout the supplied flush water in a generally tangential direction of the rim surface, thereby generating a swirling flow swirling at the lower edge of the rim surface; and a center slit opening provided between the first slit opening and the second slit opening and configured to spout flush water to the bowl portion, a slit opening shape in a cross section generally perpendicular to a flow direction of water flow spouted from the first slit opening being horizontally flattened, a slit opening shape in a cross section generally perpendicular to a flow direction of water flow spouted from the second slit opening being horizontally flattened, a swirling direction of the swirling flow spouted from the second slit opening being opposite to a swirling direction of the swirling flow spouted from the first slit opening, and the first slit opening, the center slit opening, and the second slit opening being continuous.

2. The flush toilet bowl according to claim 1, wherein the rim surface extends generally vertically.

3. The flush toilet bowl according to claim 1, wherein the rim surface is provided with an overhang at its upper end.

4. The flush toilet bowl according to claim 1, further comprising:

a second conduit configured to supply flush water to a spout opening opened in the pooling portion; and a communication port provided behind the center slit opening and allowing the first conduit and the second conduit to communicate with each other.

5. The flush toilet bowl according to claim 1, wherein flush water supplied from the second conduit through the communication port to the first conduit is spouted from the center slit opening.

6. The flush toilet bowl according to claim 1, wherein the center slit opening has a protrusion protruding downward at its upper end.

* * * * *